US006473961B1

(12) United States Patent
Segal et al.

(10) Patent No.: US 6,473,961 B1
(45) Date of Patent: Nov. 5, 2002

(54) METHOD OF MANUFACTURING MAGNETIC CORES FOR POWER TRANSFORMERS

(75) Inventors: Vladimir Segal, Livingston, NJ (US); Tri Vu, Apex, NC (US); Arthur L. Lanni, Cary, NC (US)

(73) Assignee: ABB Inc., Raleigh, NC (US)

( * ) Notice: Subject to any disclaimer, the term of this patent is extended or adjusted under 35 U.S.C. 154(b) by 143 days.

(21) Appl. No.: 09/711,284

(22) Filed: Nov. 13, 2000

(51) Int. Cl.[7] ..... H01F 3/04
(52) U.S. Cl. ..... 29/609; 29/602.1
(58) Field of Search ..... 29/609, 602.1, 29/607

(56) References Cited

U.S. PATENT DOCUMENTS 3,633,273 A * 1/1972 Wilburn et al. ..... 29/602.1
3,829,965 A * 8/1974 Mees et al. ..... 29/564.6
4,847,987 A * 7/1989 Ballard ..... 29/606
5,088,185 A * 2/1992 Siebold et al. ..... 29/602.1
5,274,904 A * 1/1994 Proise ..... 156/226

* cited by examiner

*Primary Examiner*—Derek Boles
(74) *Attorney, Agent, or Firm*—Woodcock Washburn LLP

(57) ABSTRACT

There is disclosed a method of making transformer core laminates with bent corners from magnetic strip material having a predetermined thickness and power loss in the manufacture of a low-stress polyhedral core for a power transformer. The method includes mechanically bending corners in each laminate about predetermined bending lines while limiting the zone in each corner where the laminate is subject to plastic deformation to <5 times laminate thickness so that the specific power loss in the transformer core will equal that of the magnetic strip material except within the distance from the bending lines, where the power loss is higher due to plastic deformation of the magnetic strip material.

23 Claims, 11 Drawing Sheets

Dislocation density in a laminate with 1x45° bend

Dislocation density in a laminate with 2x45° bends

Dislocation density in a laminate with 1x90° bend

Dislocation density in a laminate with 3x30° bends.
Only one bend is shown.

FIG. 12A after bend before bend FIG. 12 upper bending block
upper clamping block
movable
L
upper bending block
46
47
44
45
49
48
radius of bend
lamination
lower clamping block
radius of bend upper bending block
49
46
47
L
upper clamping block
lower clamping block
radius of bend
lamination

METHOD OF MANUFACTURING MAGNETIC CORES FOR POWER TRANSFORMERS

BACKGROUND OF THE INVENTION

1. Field of the Invention

This invention relates to the manufacture of magnetic cores for power transformers and particularly to the manufacture of single and three-phase magnetic cores for small to medium power transformers used mainly in electrical energy distribution networks.

2. Description of the Prior Art

The magnetic core is one of the two necessary elements of any transformer, the other being the windings. There are two main requirements that the magnetic core must satisfy:

(a) A closed path for the magnetic flux generated in the core by the AC current in the windings.

(b) A minimum loss of power due to the core re-magnetization process.

The most obvious solution to satisfy the first requirement is to provide a toroid-shaped core made from a continuous ribbon of magnetic strip material. However, this is not acceptable in most practical cases due to the complexity of placing the windings onto a closed core. In practice, the coil/core assembly problem is solved by making a core with one or more special joints, which are used to open up the core loops, place the windings (or wind them directly onto the straight parts of the core) and then close the loops. Joint designs with minimum resistance to magnetic flux flow throughout the core have been developed and implemented in manufacturing practice.

Minimum power loss in a core is achieved by:

(a) Making the core from a soft magnetic material (typically −3% grain oriented silicon steel or, in some special cases, an amorphous magnetic ribbon) in the form of thin laminations (to minimize eddy current loss) and (b) Directing magnetic flux flow along the easy magnetization direction throughout most of the core (except the joint sections).

There are two basic techniques to make the low-loss core:

(a) Stacking the laminates, to get a rectangular closed circuit with joints between the core elements, i.e. legs and yokes.

(b) Winding the magnetic strip into a toroidal loop with a specially cut joint, which allows one to open and close the core (after it has been shaped and annealed) to assemble it with the windings. In a stacked core, the magnetic material is not affected by plastic deformation except in a very limited area along the cut edges, so that additional power loss is generated mainly in the joints. In a well stacked single phase core, the effect of joints on core loss increase is >3%, while in a 3-phase core it is >10%. In case of a wound core, the entire length of the slit magnetic material is deformed and a stress relief anneal is needed (even in a single phase core), to avoid high power loss in the core (>15% increase of core loss).

The main drawbacks of a stacked core are the inevitable loss of expensive magnetic material (to make the joints) and complexity of precision stacking, which typically requires manual labor; while the stacked core benefits from lower core loss in the case of a 3-phase transformer and a possibility to fully optimize the core geometry.

In a wound core, the main drawbacks are: stress-relief anneal and the need for a special tooling to keep the core shape during anneal, which limits the optimization of the core dimensions, defined by the tooling dimensions. It should be noted that without stress relief anneal, core loss of the wound core is 15 to 40% higher than the core loss after stress relief. In addition, the magnetic material with highest permeability and lowest loss values (laser scribed domain refined steel) cannot be effectively used in a conventional wound core, because the effect of laser scribing is canceled by the stress relief anneal. The main benefit of a wound core is a much better use of magnetic material since 5 to 15% less material is needed to produce a 3-phase core for small power transformer and there's no scrap, which in a stacked core is >5%.

It is an object of the present invention to provide a method of manufacturing a magnetic transformer core which combines the main benefits of both the stacked and wound cores, while it eliminates their main drawbacks. The present invention provides a method of producing a scrapless core which does not require stress-relief anneal and can have filly optimized dimensions, while at the same time provides for minimum core loss, which is equal to or less than for a fully annealed wound core.

SUMMARY OF THE INVENTION

In accordance with the present invention there is provided a method of making transformer core laminates with bent corners from magnetic strip material having a predetermined thickness and power loss in the manufacture of a low-stress polyhedral core for a power transformer. The method includes mechanically bending corners in each laminate about predetermined bending lines while limiting the zone in each corner where the laminate is subject to plastic deformation to <5d where d=laminate thickness, so that the specific power loss in the transformer core will equal that of the magnetic strip material except within the zone, where the power loss is higher due to the plastic deformation of the magnetic strip material.

Further in accordance with the present invention there is provided a method of making transformer core laminates with bent corners from magnetic strip material having a predetermined thickness and power loss in the manufacture of a low-stress polyhedral core for a power transformer including the steps of cutting a strip of magnetic material to a predetermined length corresponding to one-half the length of a single turn of the core and reflecting the position of the turn in the core to form a rectangular half-laminate, positioning the half-laminate between a male die and a female die at a bending station, moving the male die toward the female die and against the half-laminate so that a first bend in the first corner is made about a predetermined bending line and at predetermined angle, advancing the half-laminate through the bending station to reach a position for the formation of a second corner in the laminate and moving the male die toward the female die and against the half-laminate so that the first bend in the second corner of the laminate is made about a predetermined bending line and at a predetermined angle, and during the bending of each corner, limiting the zone in each corner where the laminate is subject to plastic deformation to <5d, where d=laminate thickness, so that the specific power loss in the transformer core will equal that of the magnetic strip material except within the zone, where the power loss is higher due to the plastic deformation of the magnetic strip material.

Further in accordance with the present invention there is provided a method of making transformer core laminates with bent corners from magnetic strip material having a predetermined power loss in the manufacture of a low-stress polyhedral core for a power transformer including the steps of mechanically bending corners in each laminate about predetermined bending lines while limiting the plastic deformation to ±1.5 mm from each bending line so that the specific power loss in the transformer in the transformer core will equal that of the magnetic strip material except within ±1.5 mm from the bending lines, where the power loss is higher due to plastic deformation of the magnetic strip material. In one aspect of the invention each corner of each transformer core laminate is produced by subjecting the laminate to one step of deformation by bending to produce a full 90° corner, comprised of one 90° bend. In another aspect of the invention each corner of each transformer core laminate is produced by subjecting the laminate to two steps of deformation by bending to produce a full 90° corner, comprised of two 45° bends. In another aspect of the invention, each corner of each transformer core laminate is produced by subjecting the laminate to three steps of deformation by bending to produce a full 90° corner, comprised of three 30° bends.

In accordance with another aspect of the invention there is provided a method to produce transformer core laminates consisting of two pieces, half-laminates, each having two right corners consisting of 1×90°, 2×45°, or 3×30° bends, so that a closed turn is produced with a butt joint between the ends of the two half-laminates.

Further in accordance with the invention, there is provided a method of making transformer core laminates with bent corners from magnetic strip material having a predetermined power loss in the manufacture of a low-stress polyhedral core for a power transformer including the steps of cutting a strip of the magnetic material to a predetermined length corresponding to one-half the length of a single turn of the core and reflecting the position of the turn in the core to form a rectangular half-laminate, positioning the half laminate between a male die and a female die at a bending station, moving the male die toward the female die and against the half-laminate so that a first bend in a first corner is made about a predetermined bending line and at a predetermined angle, advancing the half-laminate through the bending station to reach a position for the formation of a second corner in the laminate and, moving the male die toward the female die and against the half-laminate so that the first bend in the second corner of the laminate is made about a predetermined bending line and at a predetermined angle, and during the bending of each corner limiting the plastic deformation to ±1.5 mm from each bending line so that the specific power loss in the transformer core will equal that of the magnetic strip material except within ±1.5 mm from the bending lines, where the power loss is higher due to plastic deformation of the magnetic strip material. Further in accordance with the invention the corners are formed so that at no time the convex tip of the bend comes into direct contact with the female part of the die and no part of the laminate is simultaneously in direct contact with the male and female parts of the die.

For a more detailed disclosure of the invention and for further objects and advantages thereof, reference is to be had to the following description taken in conjunction with the accompanying drawings.

BRIEF DESCRIPTION OF THE DRAWINGS

FIG. 12A is a view similar to FIG. 13 after the core laminate has been bent 90°

DETAILED DESCRIPTION OF THE PREFERRED EMBODIMENTS

The method of the present invention is particularly useful in connection with the manufacture of single or three-phase polyhedral transformer cores with step-lap joints and will be described in connection with the various figures. The core corners are produced in the individual laminates by bending the laminates in a particular way and preferably with specifically shaped upper and lower dies as hereinafter described. The step-lap joint is formed by the sequence of laminates with the ends shifted one after another at a given length (overlaps). An important feature of the invention is the use of a special bending technique, to bend the laminates along the lines corresponding to the desired positions of the core corners. The bending method has been chosen so as to minimize the steel deformation in the corners. The method includes mechanically bending corners in each laminate about predetermined bending lines while limiting the zone in each corner where the laminate is subject to plastic deformation to <5d where d=laminate thickness. The general range of material thickness from 0.02 to 0.50 mm covers most materials used to manufacture transformer cores from amorphous ribbon (0.02 to 0.05 mm) to ultra-thin silicon steels for high frequency applications (0.05 to 0.15 mm) to grain oriented silicon steels (0.18 to 0.50 mm). The material thickness range where the present invention finds its main use is 0.18 to 0.35 mm. In most applications the plastic deformation will be limited to ±1.5 mm from the corner bending lines, (i.e. 1.5 mm on both sides of the bending line or a zone of 3 mm. It has been determined experimentally that with the bending method of the present invention the power loss increase (ΔW) in a transformer core rated at >/=25 KVA (single phase) and at >/=75 KVA (3-phase) is equal to or less than ΔW for a filly annealed wound core made by any of the other prior techniques. For smaller cores, the manufacturing technique described in this invention may result in higher loss values. To avoid significantly higher core loss (>3% difference) versus conventional wound core, the minimum rating of core produced according to this invention preferably should be limited to 15 KVA for single phase and 50 KVA for three-phase cores. The maximum rating for which the present method was tested was 1500 KVA, although the present invention is not limited to that value.

Figure 1:
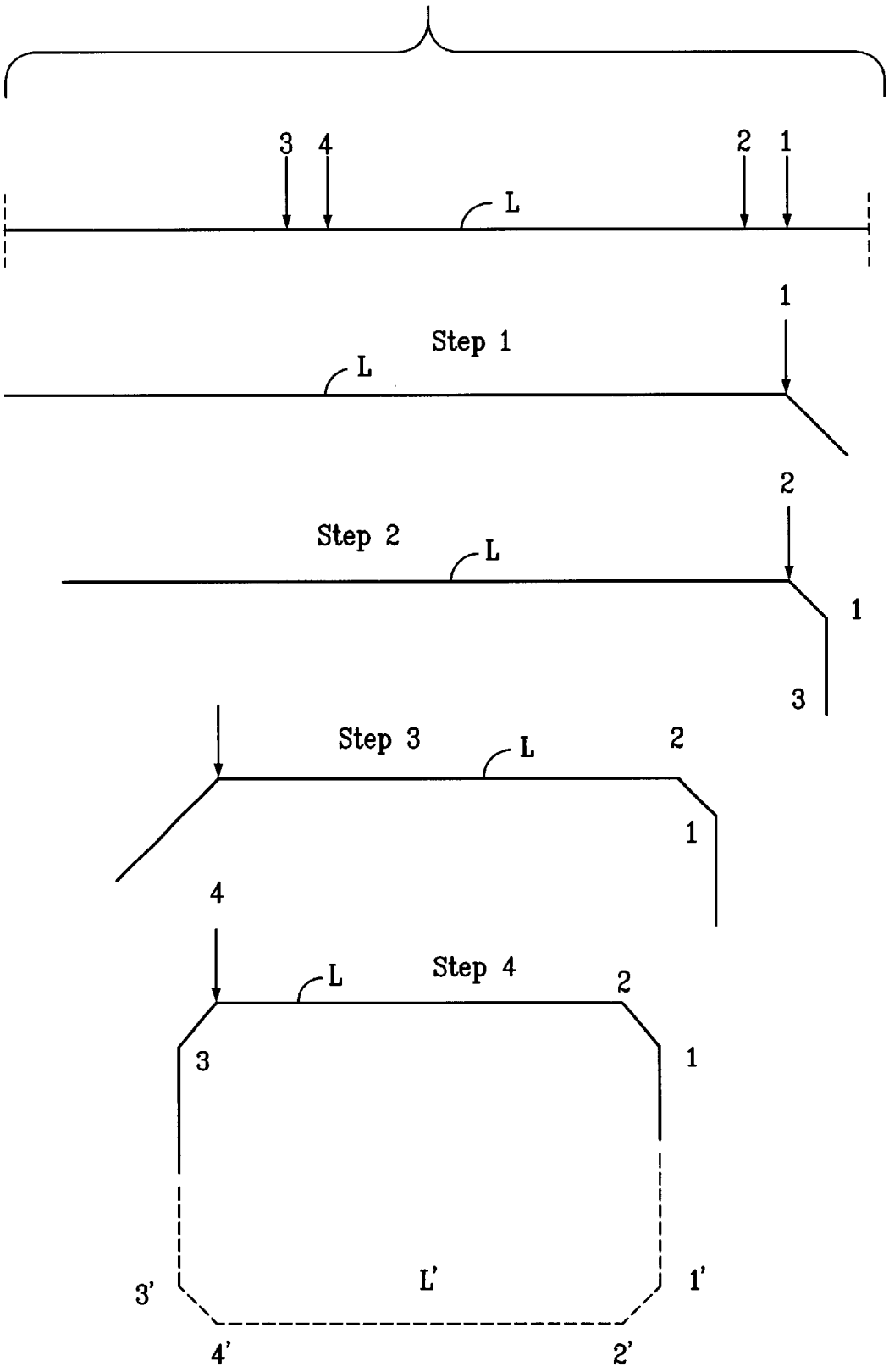
FIG. 1 is a schematic drawing illustrating the bending sequence to produce a core laminate with two 2×45° bend corners in accordance with the present invention.
Figure 5:
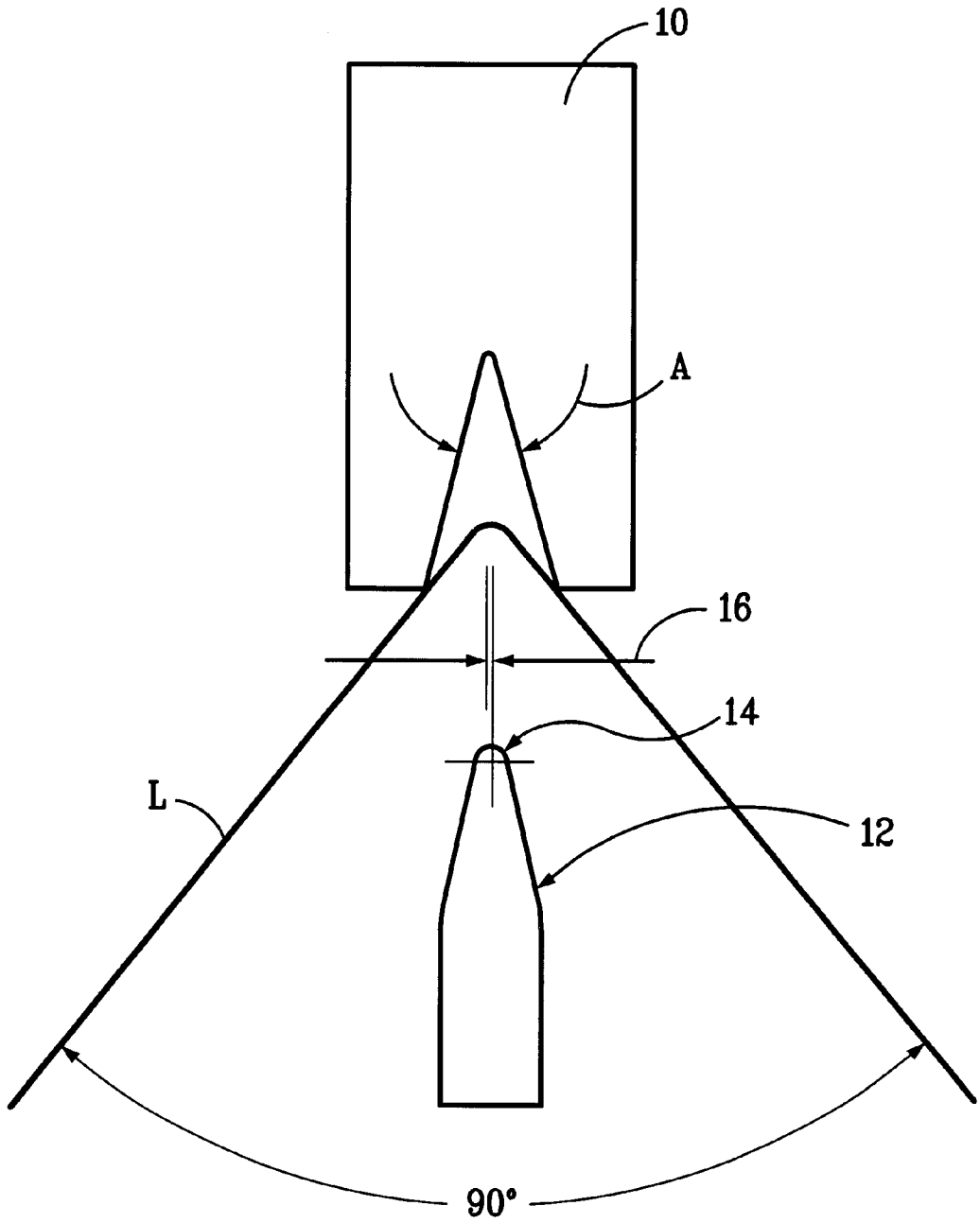
FIG. 5 is a schematic drawing of a die design for forming the bent corners in accordance with the present invention.
Figure 6:
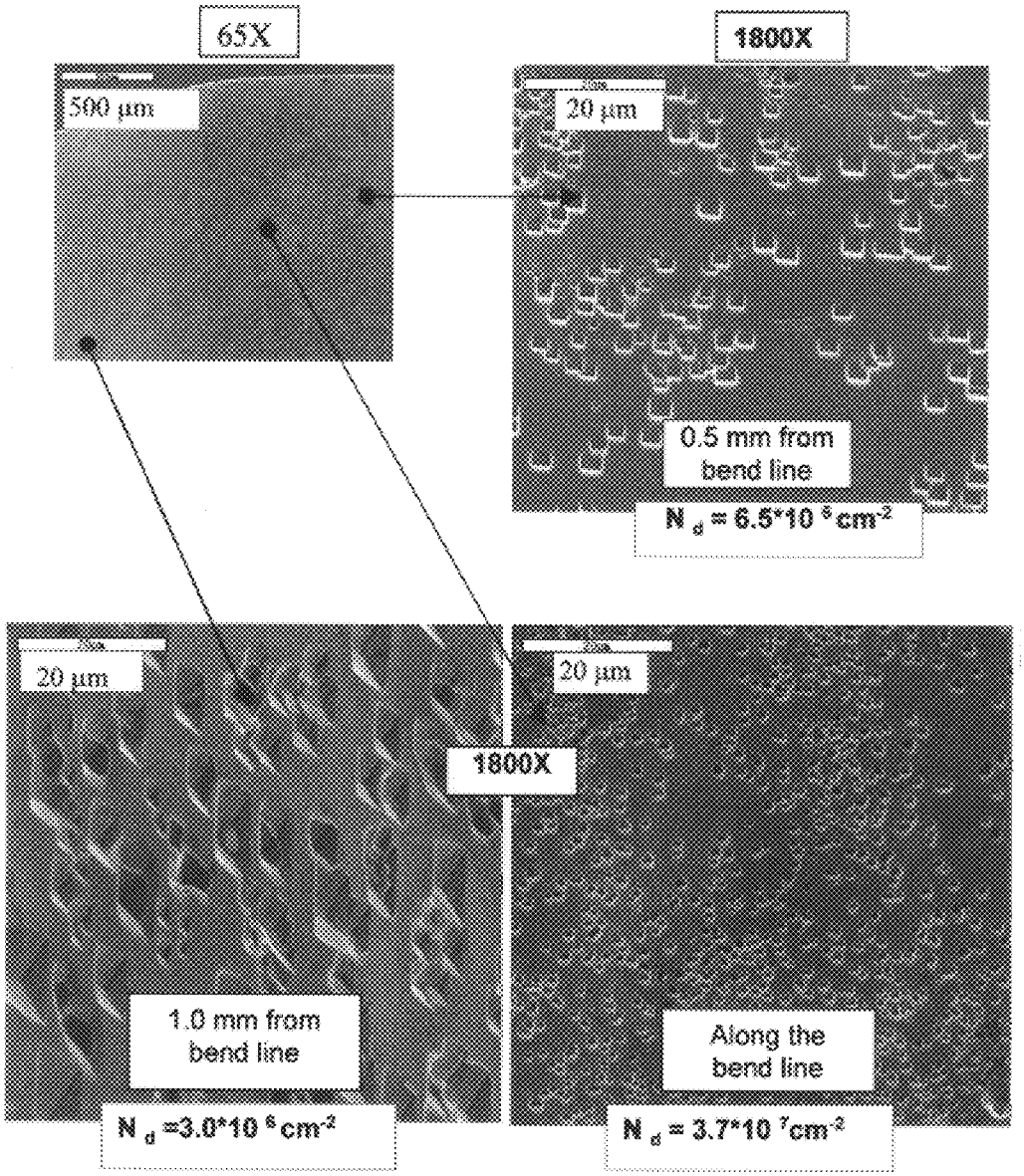
FIG. 6 is a photomicrograph showing the dislocation density in a core laminate with 1×45° bend according to the present invention.
Figure 7:
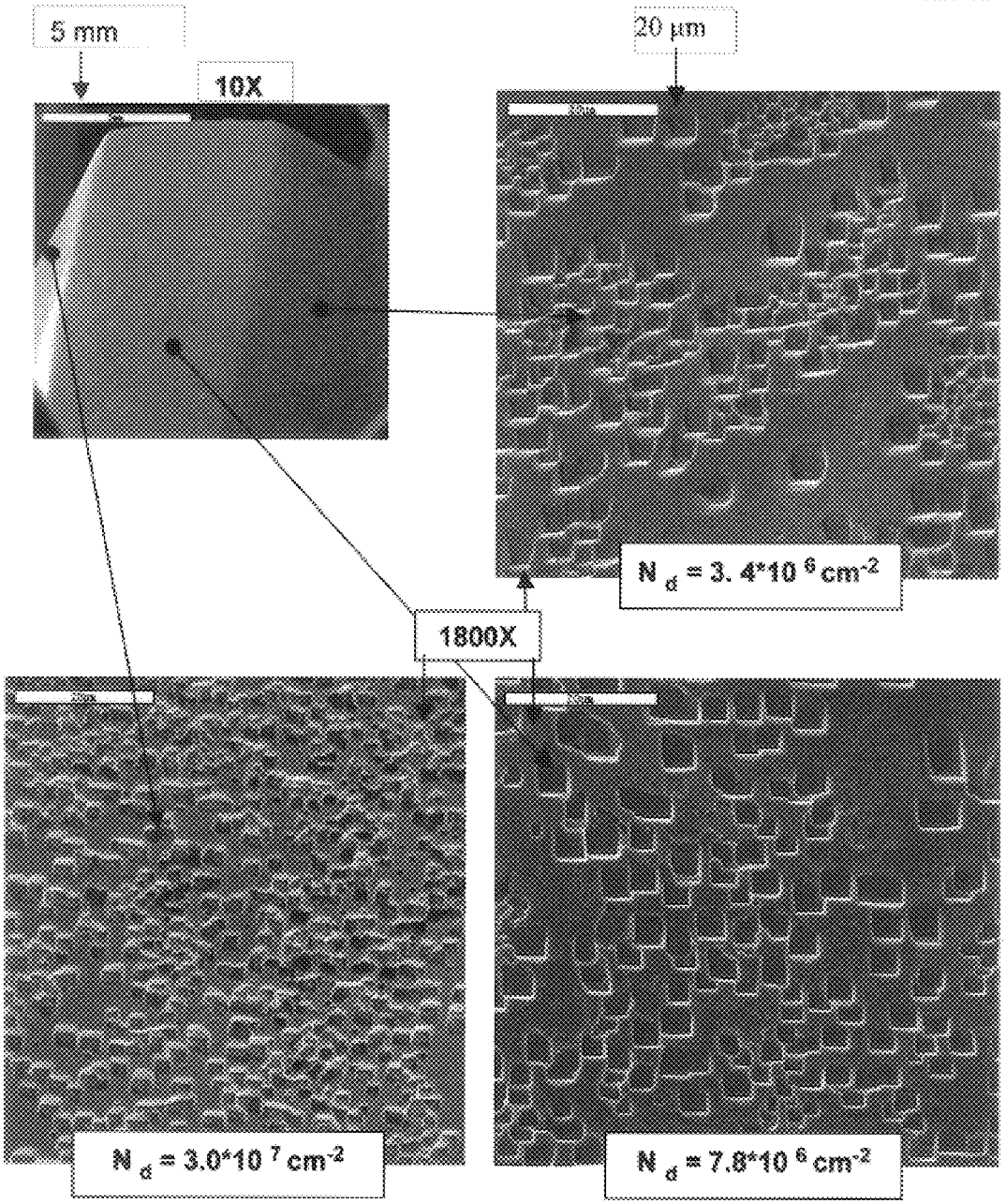
FIG. 7 is a photomicrograph showing the dislocation density in a core laminate with 2×45° bends according to the present invention.
Figure 8:
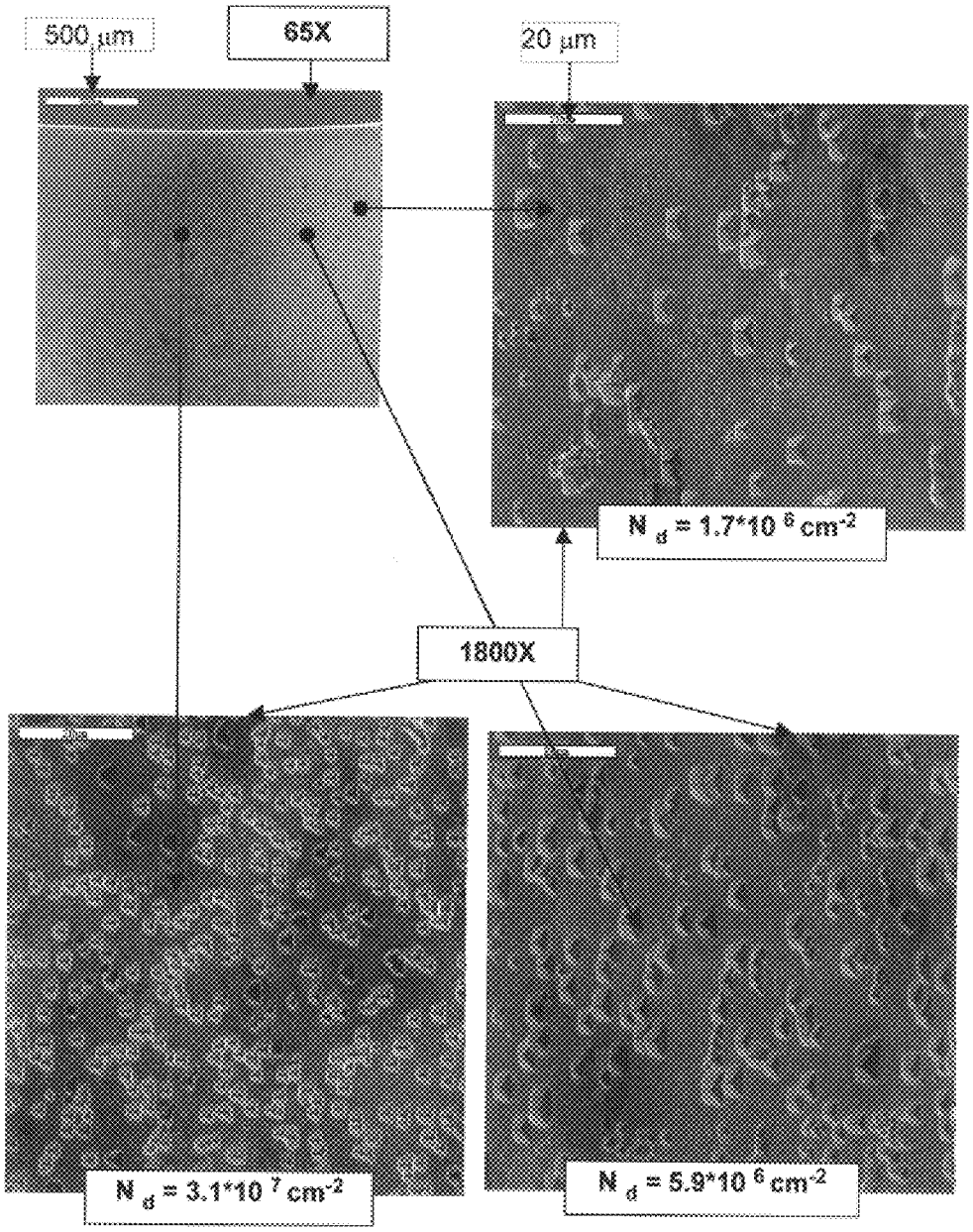
FIG. 8 is a photomicrograph showing the dislocation density in a core laminate with 1×90° bend according to the present invention.
Figure 9:
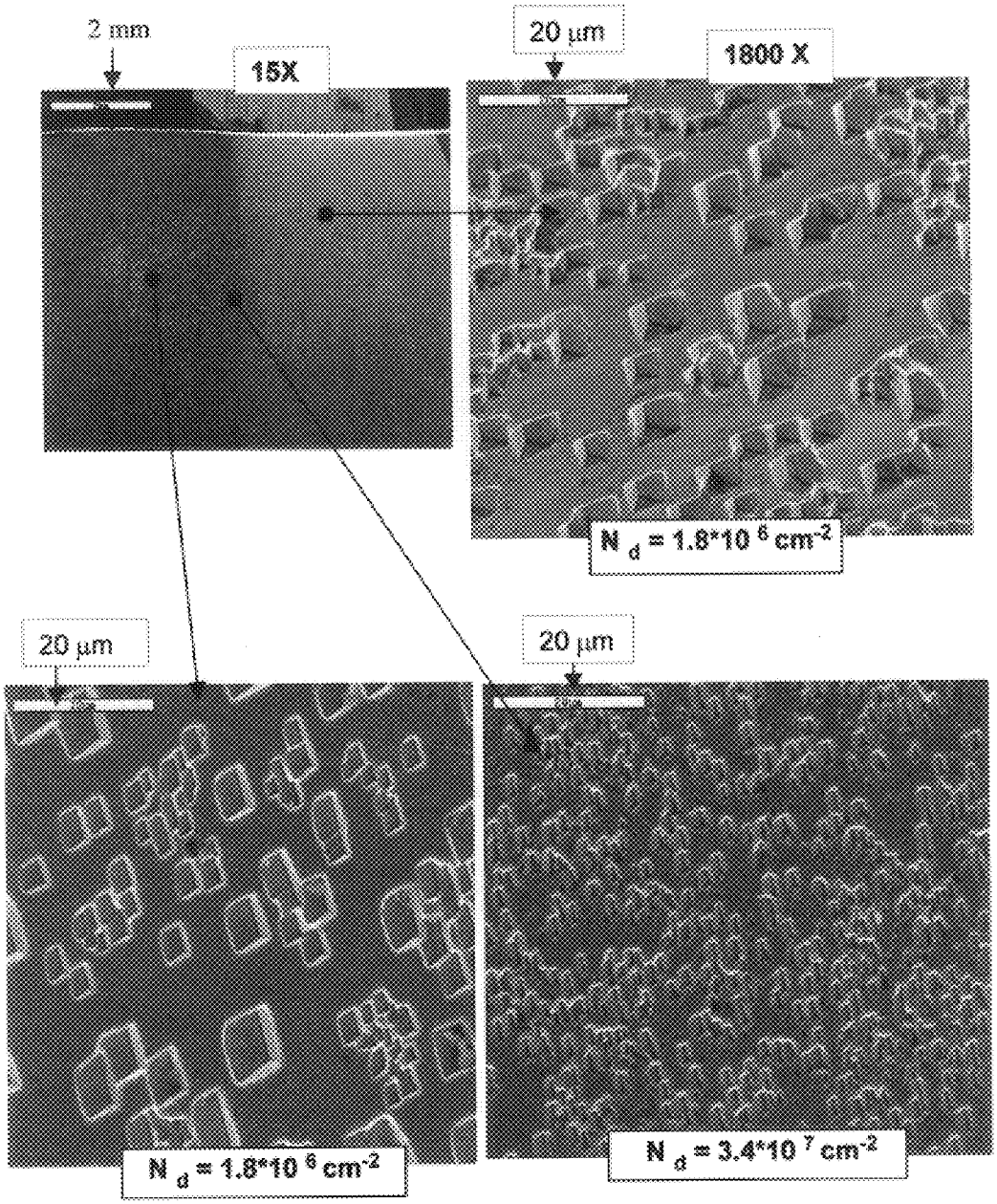
FIG. 9 is a photomicrograph of the dislocation density in a core laminate with 3×30° bends, only one being shown, according to the present invention.

The sequence of operations utilized in the present invention to produce a single loop with two step-lap joints can be better understood by reference to the drawing in FIG. 1. A coil of magnetic strip material is unwound from a decoiler (not shown) and indexed forward, so that a rectangular piece L, equal in length to one-half of the innermost turn of the core (half-laminate), is cut from the strip and positioned inside a bending tool such as the die for "acute angle air-bending" illustrated in FIG. 5. An example of a bending station is illustrated in FIG. 5 and includes an upper die 10 which is a female die and preferably opens at an angle A equal to 30±5 degrees. A lower male die 12 is located at the bending station for cooperation with the upper die 10. The lower die 12 preferably has a rounded tip 14 having a radius R=0.02–0.06 mm and a flat tip 16 having a width of 0.005–0.020 mm. The laminate L is positioned between the upper die 10 and the lower die 12 and is illustrated as having been bent at an angle of 90°. The lower die 12 is pushed upwardly to make the bend in the corner in the laminate. In the laminate L after bending, the convex part of the bend does not come into contact with the upper die 10, the laminate L slides freely inside the upper die opening at a distance defined by the bending angle which in the illustrated position in FIG. 5 is 90° and the material thickness which may vary from 0.02–0.50 mm, the latter being the normal material thickness range for transformer core laminates. In making the transformer core laminates, each corner of each transformer core laminate is produced by subjecting the laminate to one or more steps of deformation by bending to produce a full 90° corner. Such corner may be comprised of one 90° bend, or two 45° bends or three 30° bends.

In the example illustrated in FIG. 1, the bending sequence is illustrated to produce a laminate with two×45° bend corners. The piece of magnetic strip material L moves from left to right. The die position is shown by the arrows one, two, three and four. Each bend in the laminate is produced by a single stroke of the lower die 12, which pushes the laminate L into the upper or female part 10 with no contact between the convex (upper side of the half-laminate) and the female part of the die. In FIG. 1, Step 1 illustrates the production of the first bend in the first corner which is made at a predetermined angle. In the example illustrated, the predetermined angle is 45°. However, as indicated above, the predetermined angle may be 30° or 90° depending upon the desired shape of the corner. The half-laminate L is indexed forward 2, 1 or 0 times and additional 2 (30°), 1(45°) or 0(90°) bends are produced by the same die to complete the formation of the first 90° corner as illustrated in Step 2 in FIG. 1. The half-laminate L is indexed further to reach the position of the second corner and the above operations are repeated to form the second corner as illustrated in Steps 3 and 4 in FIG. 1. The 1×90 or 3×30 bend corners are produced in a similar way as the 2×45 bend corners, with the bends of different angles made by pushing the laminate L to a different depth in the upper female die 10. The half-laminate L with two bent corners (3×30, 2×45 or 1×90°) was pushed forward to fall onto a stacking table (not shown). All of the above steps are repeated with the difference that the length of half-laminate and distance between the corners are changed to produce the next half-laminate, which fits tightly over the innermost piece positioned on the stacking table. The above operations are repeated n times until the desired stack thickness (or core build) is produced. The other half-laminate L' which completes the turn of the core is formed by Steps 1', 2', 3', 4' with the only difference being that the length of the vertical parts of the laminate are reversed. In FIG. 1 the half-laminate L' is shown after it is turned 180° for assembly with the first half-laminate L. To equalize the thickness of the two half-laminates forming one turn of the core loop, the two halves of the full core loop are produced in alternating sequence as shown in FIG. 1. Each succeeding half-turn laminate turn (to be placed over the previous piece) is made from a piece of magnetic material, which has a different length than the previous one: $L_2=L_1+4d+0.01d$. Thus, the outermost laminate has a length $L_n=L_1+4(n-1)*d+0.01n*d$, where $L_1$=length of the innermost laminate, n=number of layers (turns) in the core, d=thickness of magnetic material, 0.01d is the stacking tolerance to guarantee that no force is used to produce the stack. The overlap between the adjacent laminates (to produce a step-lap joint) is achieved by shifting the position of the corners at a distance prescribed by core design. Typically, the overlap equals from 3 mm to 10 mm for cores rated 25 to 2500 KVA correspondingly.

Figure 2B:
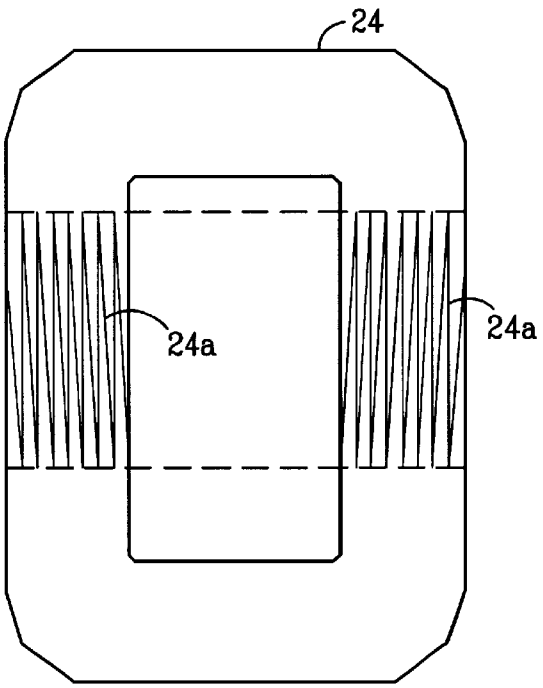
FIG. 2B illustrates a bent transformer core with 3×30° bend corners and step lap joints on the core legs.
Figure 2A:
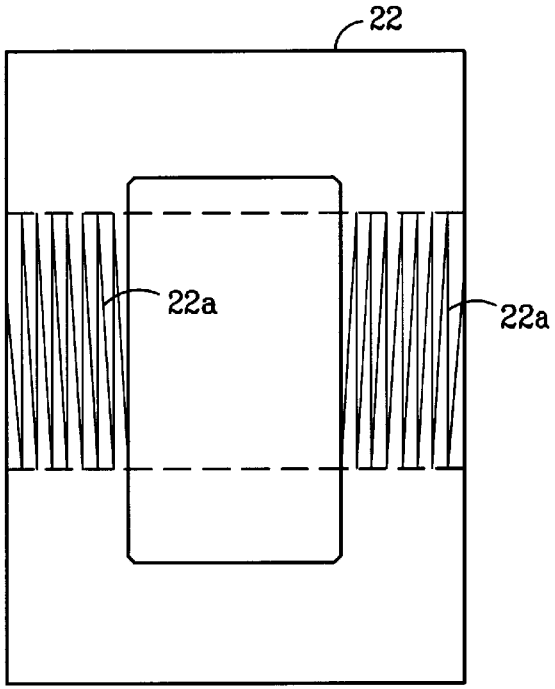
FIG. 2A illustrates a bent transformer core with 1×90° bend corners and step-lap joints on the core legs.
Figure 2:
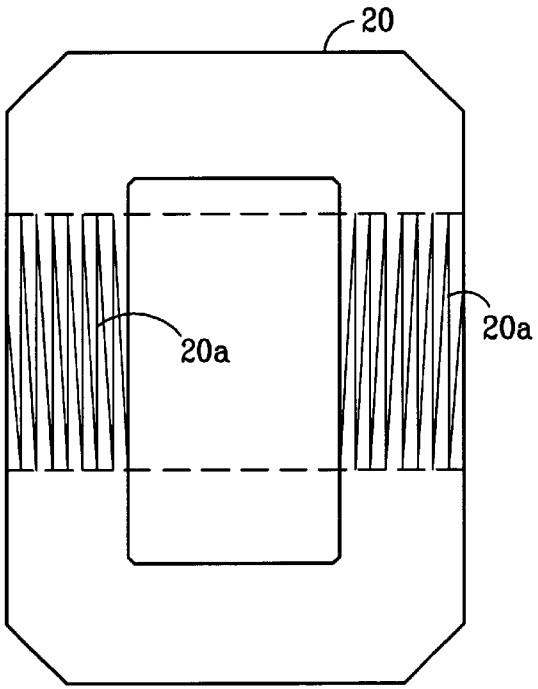
FIG. 2 illustrates a bent transformer core with 2×45° bend corners and step-lap joints on the core legs.
Figure 3:
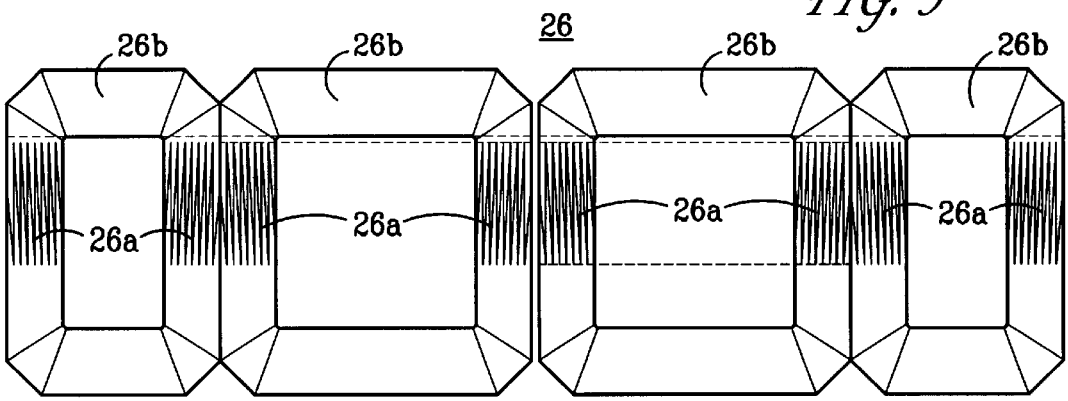
FIG. 3 illustrates a 4-loop core for a 3-phase transformer with 2×45° bend corners in all four loops.
Figure 4:
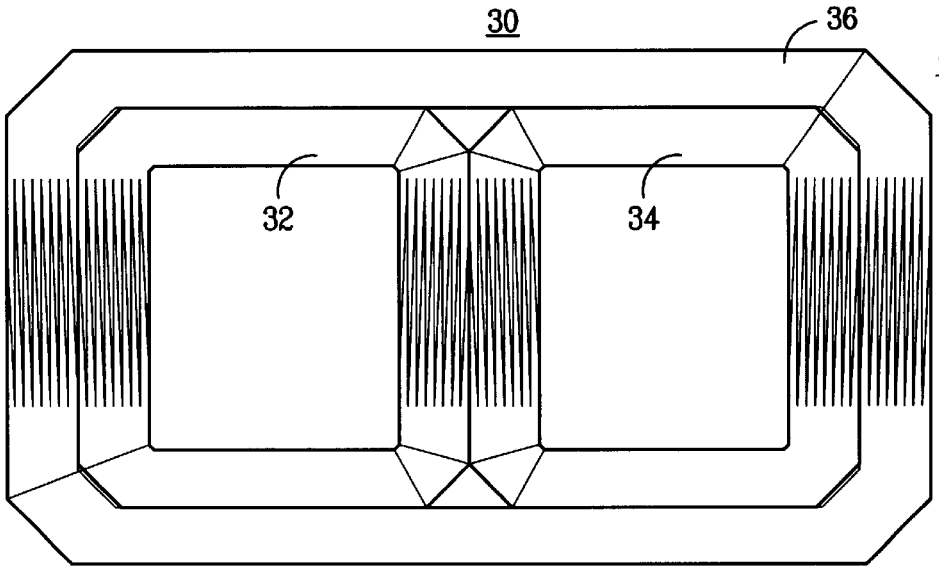
FIG. 4 illustrates a bent core of the so-called "Evans" design for a 3-phase transformer with step-lap joints on the core legs.

The above sequence of steps is applicable in the method of producing different single and 3-phase core designs such for example as shown in FIGS. 2–4. In FIG. 2 there is illustrated a bent transformer core 20 with 2×45° bend corners and step-lap joints 20*a* on the core legs. In FIG. 2A there is illustrated a bent transformed core 22 with 1×90° bend corners and step-lap joints 22*a* on the core legs. In FIG. 2B there is illustrated a bent transformer core 24 with three 30×30° bend corners and step-lap joints 24*a* on the core legs. In FIG. 3 there is illustrated a four-loop core 26 with 2×45° bend corners for a 3-phase transformer. The core made as shown is made with bent corners in all four loops. While 2×45° bend corners have been illustrated in FIG. 3, the 1×90° or 3×30° bend corners can be used as well as illustrated in FIGS. 2A and 2B. The step-lap joints 26*a* have been illustrated in FIG. 3 on the core legs although they can be made on the yokes 26*b* to allow for a direct coil winding on the core legs. FIG. 4 illustrates a bent core 30 of a so-called "Evans" design for a 3-phase transformer. Two inner cores 32, 34 are embraced with an outer core 36, so that a 3-phase transformer core is produced. The corners illustrated have 2×45° bends. Where it is desired to have the coils wound directly on the legs in any of the designs, the step-lap joints are made in the yokes as illustrated in the core 38 in FIG. 4A.

The best results, i.e. lowest core loss and highest stacking factor (defined as the ratio of actual core mass to the mass of a solid piece of magnetic material, having the same shape and dimensions as the bent core) were achieved by using a die design as shown in FIG. 5. The two important parameters of the die: radius of curvature and its wedge angle were determined experimentally. It is to be understood that others skilled in the art of manufacture of transformer cores may determine another combination of these two parameters of the die, to achieve the purpose of this invention, provided the procedures recommended above are followed. Two empirical criteria, to be satisfied by the bent core, were determined in experiments carried out to verify the present invention. First, core loss for a bent core, without stress relief anneal, shall not exceed by more than 3% core loss of a conventional wound core of the same mass and cross section, but with a full stress relief anneal, second, the difference in stacking factor for the same two cores shall be <1%.

It was found experimentally that the above criteria can be satisfied by forming the corners, so that at no time the convex tip of the bend comes in direct contact with a female part of the die and no point of the laminate is simultaneously in direct contact with the male and female parts of the die.

mm from the bending lines. Outside these narrow zones, adjacent to the bending lines, there is practically no increase in dislocation density as compared to the non-deformed parts of the laminate and, correspondingly, no increase in specific core loss in the magnetic material. The empirical correlation between the plastic deformation in the corners and the core loss increase (as compared with a fully annealed core) has been found to follow the equation: $\Delta P=100^*(8/L)$, where $\Delta P$=core loss difference between a bent (not annealed) and a wound (fully annealed) core (in %), where L=mean value of the core perimeter (total length of the middle turn of the core, mm). To keep $\Delta P$ <3%, it is recommended to produce bent cores according to this invention for transformers rated >15 KVA for single-phase and >40 KVA for three-phase transformers.

Figure 10:
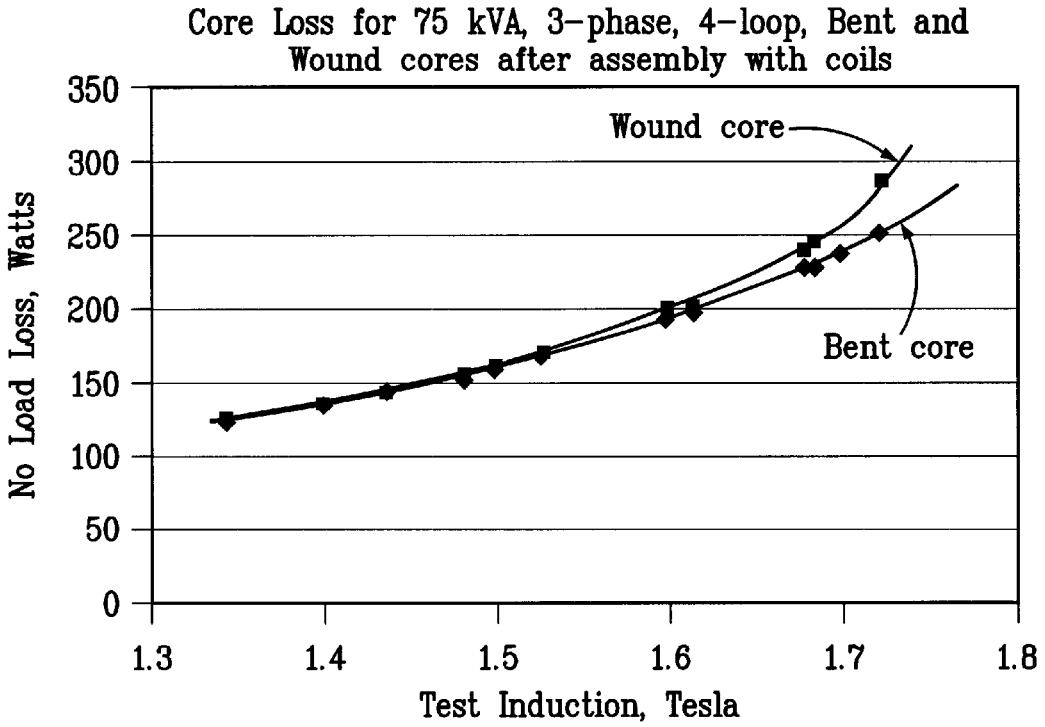
FIG. 10 is a graph showing the core loss for a 75 KVA, 3-phase, 4-loop, bent and wound cores after assembly with coils.
Figure 11:
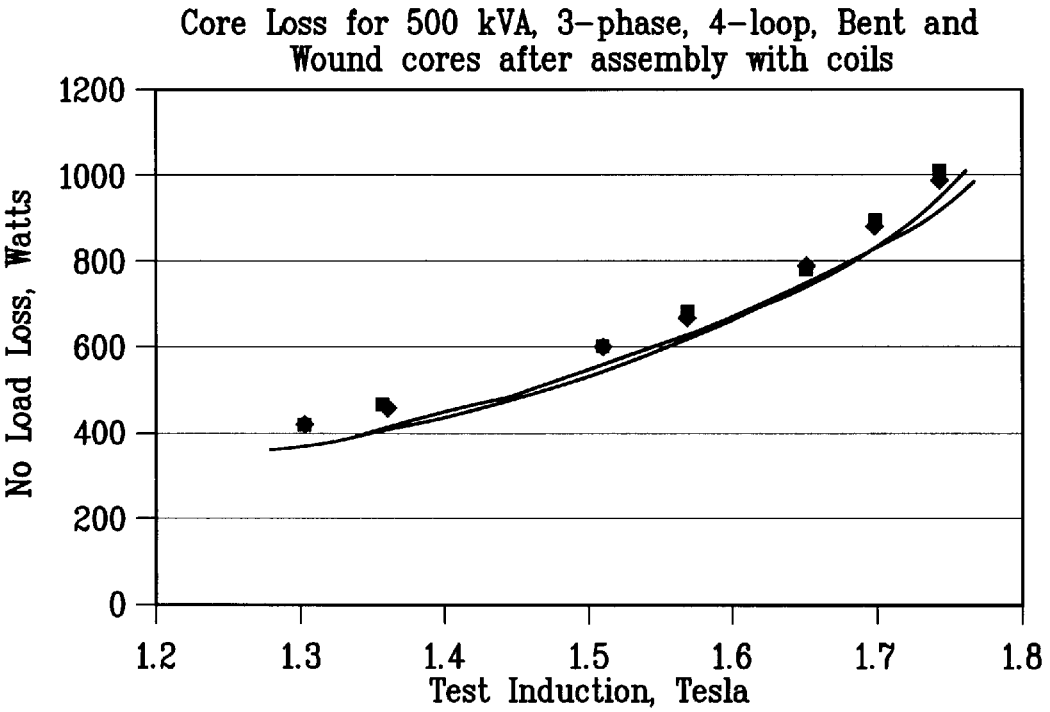
FIG. 11 is a graph showing the core loss for 500 KVA, 3-phase, 4-loop, bent and wound cores after assembly with coils.

The magnetic performance and stacking factor of cores produced according to present invention were verified by testing several bent cores of different designs as shown in Table 1, FIGS. 10 and 11.

TABLE 1

Core Loss measured for a different core designs with bend corners (without stress relief anneal) and for conventional wound cores (with stress relief anneal)

| Core Design (all 1-phase cores had the rating 25 KvA, all 3-phase cores had | No Load Loss (NLL), Watts, for cores with laminations made from: 0.23 RGO at Induction: | | 0.23 HiBDR at Induction | | Destruction Factor: NLL/Iron Loss | | Stack. Factor |
|---|---|---|---|---|---|---|---|
| rating 75 KVA | 1.5 Tesla | 1.7 Tesla | 1.5 Tesla | 1.7 Tesla | 1.5 T | 1.7 T | % |
| Bent 1x90, 2-loop, 1-phase | 61 | 89 | 55 | 76 | 1.02 | 0.97 | 95 |
| Bent, 2x45, 2-loop, 1-phase | 57 | 87 | 54 | 75 | 0.98 | 0.95 | 96.5 |
| Bent, 3x30, 2-loop, 1-phase | 56 | 85 | 53 | 74 | 0.97 | 0.93 | 96.5 |
| Bent, 1x90, 4-loop, 3-phase | 169 | 244 | 153 | 211 | 1.26 | 1.23 | 95 |
| Bent, 2x45, 4-loop, 3-phase | 162 | 244 | 151 | 207 | 1.24 | 1.23 | 96.5 |
| Bent, 3x30, 4-loop, 3-phase | 161 | 243 | 150 | 206 | 1.24 | 1.22 | 96.5 |
| Bent, 1x90, Evans, 3-phase | 189 | 290 | 166 | 228 | 1.22 | 1.20 | 96.5 |
| Bent, 2x45, Evans, 3-phase | 184 | 284 | 163 | 223 | 1.23 | 1.22 | 97 |
| Bent, 3x30, Evans, 3-phase | 181 | 280 | 161 | 221 | 1.23 | 1.22 | 97 |
| Wound, 2-loop, 3-phase | 58 | 88 | N/A | N/A | 0.99 | 0.98 | 97 |
| Wound, 4-loop, 3-phase | 162 | 259 | N/A | N/A | 1.26 | 1.25 | 96.5 |
| Wound, Evans, 3-phase | 195 | 304 | N/A | N/A | N/A | N/A | N/A |

It is believed that meeting these two conditions allows for a practically free "flow" of the magnetic material towards the tip of the bend, so that no elongation of the laminate occurs during bending, except in the immediate vicinity of the bending line (±1.5 mm).

A metallurgical study was carried out to establish the fundamental reasons for the extremely low core loss→>20% lower than the core loss of a conventional wound core prior to it being stress-relieved. The dislocation density along the bending lines and in their immediate vicinity was investigated. It has been found as shown in the photomicrographs in FIGS. 6–9 that the bending method taught by the present invention, limits the measurable plastic deformation to ±1.5

Cores were made with 1×90, 2×45 and 3×30 degrees bent corners with the laminates made from either regular grain oriented steel 0.23 mm thick (0.23 RGO), which is often used for high quality wound cores or with the laminates made from domain refined high permeability steels with the same thickness (0.23 HiBDR), which are not used in conventional wound cores, because stress relief increases the loss in HiBDR material ~10%. As Table 1 shows, independently on the number of bends (1, 2 or 3), used to make the corners, the bent cores have practically the same specific core loss and destruction factors as the fully annealed wound cores. The bent cores made with HiBDR material have the lowest core loss, which under no circumstances can be achieved for a conventional wound core.

One particularly important advantage of cores made according to this invention is that they can be made of a larger size (for large distribution transformers rated at >2000 KVA) than the wound ones, because the latter are limited by the difficulties in annealing large cores. Moreover, it was found experimentally that for larger sizes the bent cores have lower specific core loss (i.e., loss per unit mass of the core) than the fully annealed wound cores, because of the difficulties in keeping the shape of the large wound cores during stress relief anneal.

Figure 4A:
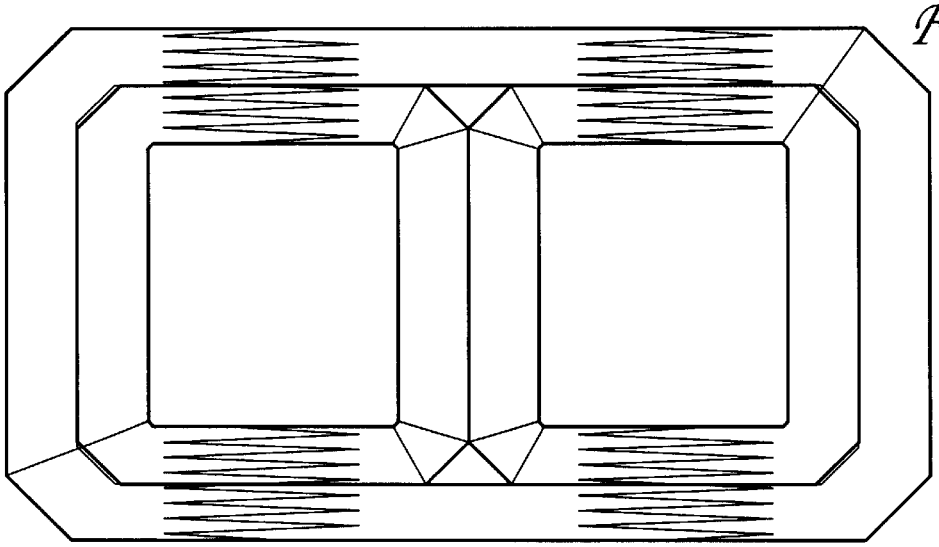
FIG. 4A illustrates a bent core of the "Evans" design for a 3-phase transformer with the step-lap joints on the yokes.

The two step-lap joints in a bent core simplify the core assembly with the coils and provide for a direct winding of coil onto the core legs, which is impossible in case of single-joint cores. In case the direct coil winding is desired, the bent core is made with the joints located on the yokes instead of the legs. An example of such a design is shown in FIG. 4A.

Figure 12:
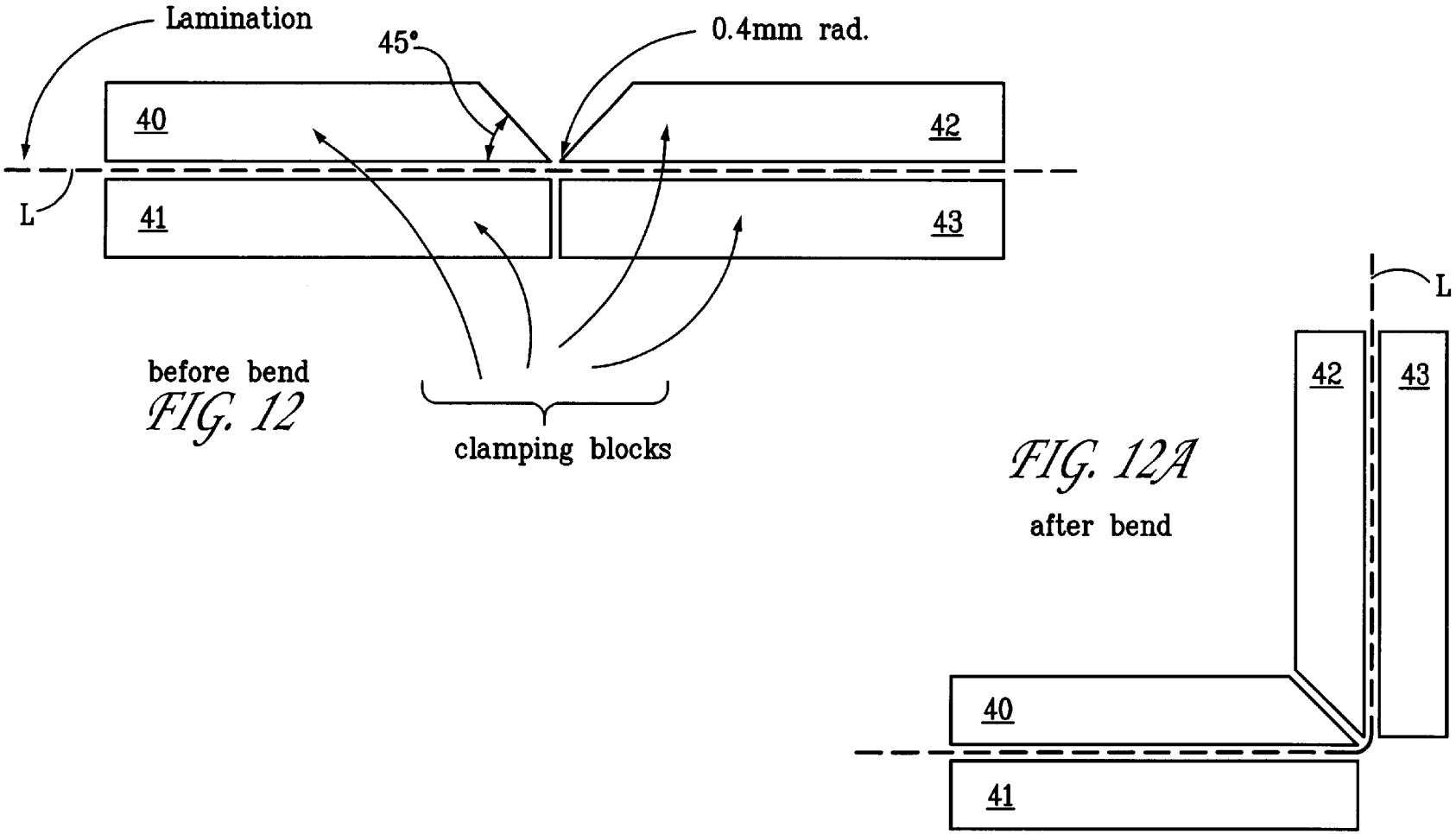
FIG. 12 is a schematic drawing illustrating an alternative method of producing a 90° bend in a core laminate.

While a preferred method of the present invention has been described and illustrated in connection with FIGS. 1 and 5 utilizing a die design for forming the bent corners in accordance with the present invention, other methods of bending may be utilized wherein during the bending of each corner the plastic deformation is limited to ±1.5 mm from each bending line so that the specific power loss in the transformer core will equal that of the magnetic strip material except within ±1.5 mm from the bending lines, where the power loss is higher due to plastic deformation of the magnetic strip material. In FIG. 5 a die design was illustrated for forming the bent corners in accordance with the present invention. In FIG. 12 there is illustrated an alternative technique for performing such bending operations. In all of the methods disclosed herein it is the object of the invention to subject only a very small part of the magnetic strip to plastic deformation by bending. In FIG. 12 the magnetic strip or laminate L is placed between two pairs of clamping blocks 40, 41 and 42, 43. The inner ends of the blocks 40, 41 and 42, 43 are placed on opposite sides of the bending line about which the corner is to be formed in the laminate. The inner ends of the upper blocks 40 and 42 are beveled at an angle of 45° so that when the pair of blocks 42, 43 are moved to the bent position in FIG. 12A, the laminate L will be subjected to one step of deformation by bending to produce a full 90° corner. It has been found that to achieve a 90° bending of a magnetic strip 0.2–0.3 mm thick, the outer steel layers will be deformed (elongated) within a zone ±0.5 mm from the corner bending line, while the inner layers will be compressed within a zone of ±0.3 mm from the bending line. Assuming the average perimeter for a single turn of a typical wound core is equal to 1200 mm, it will be 4/1200 maximum ratio of deformed to undeformed steel. Accordingly, only 0.3 to 0.4% of steel is subjected to plastic deformation. Assuming further that there is 100% power loss increase in the deformed zone (which is a conservative but realistic estimate), the core laminate will have less than 0.5% power loss increase due to plastic deformation of the magnetic laminate.

Figures 13, 13A:
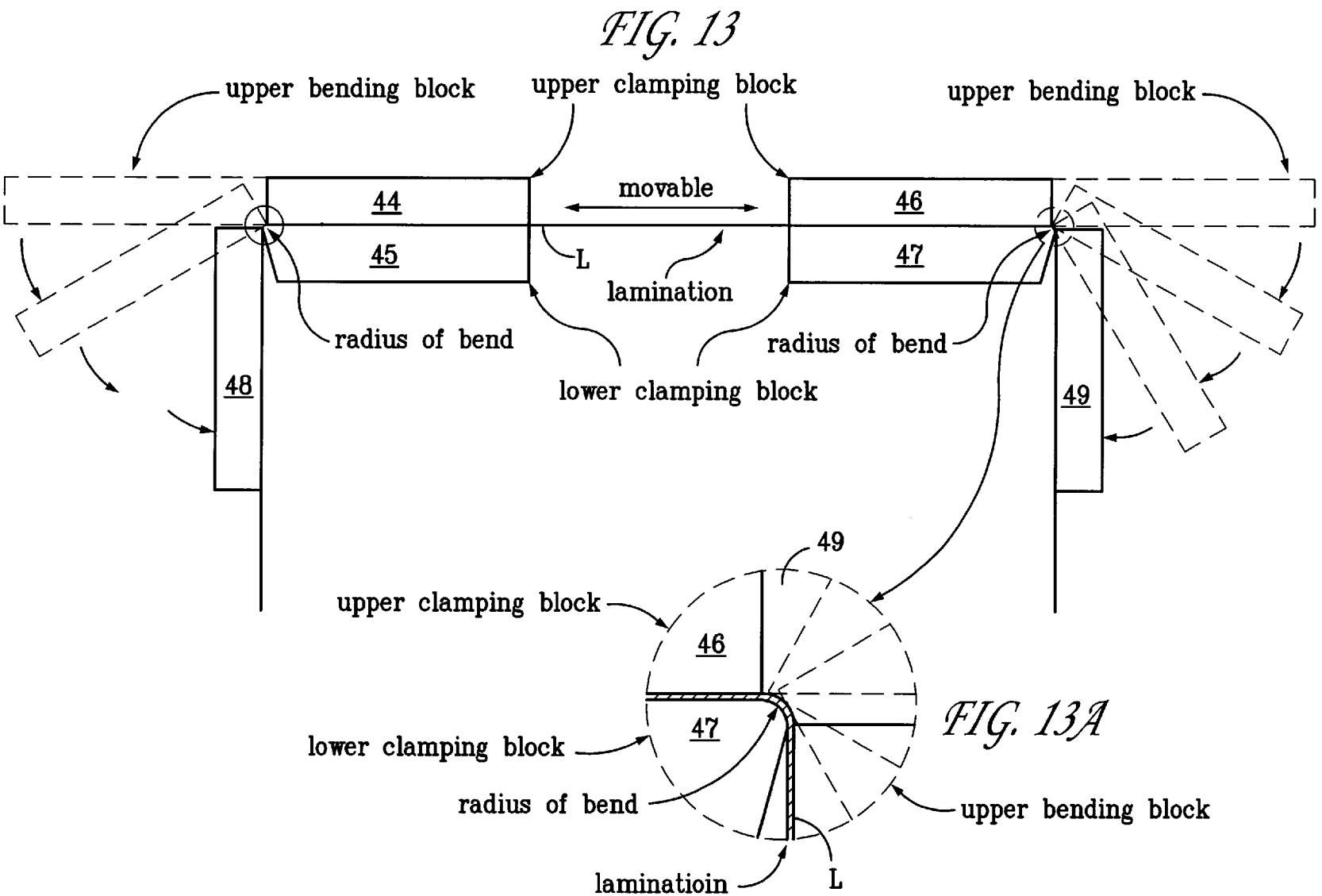
FIG. 13 is a schematic drawing illustrating the bending of two 90° bend corners in a core laminate in accordance with an alternative method.
FIG. 13A is an enlarged view of the bulls eye area in FIG. 13.

Referring to FIGS. 13 and 13A there is illustrated a method of producing a transformer core laminate consisting of two pieces, half-laminates, each having two right corners. A steel cutting machine (not shown) with programmable cutting blades is set so that each half of a laminate forming the single turn of a core is cut to a pre-calculated length reflecting the position of the turn in the core. The total length of the two precisely equal halves of each next consecutive turn is increased by $\Delta L=8d$ where d=steel thickness. The bending is done so that two corners in one half of the turn are produced at the same time. The predetermined length of the cut strip of magnetic laminate L includes a core leg section intermediate a pair of half yoke sections. The core leg section is clamped adjacent one end thereof between a first pair of clamping blocks 44 and 45. The opposite end of the core leg is clamped between a second pair of clamping blocks 46 and 47. A first bending block 48 is placed against one of the half yoke sections adjacent the first pair of clamping blocks 44, 45 and a second bending block 49 is placed against the other half yoke section adjacent the second pair of clamping blocks 46, 47. A force is then applied to the bending blocks 48 and 49 to rotate the half yoke sections downwardly to an angle of at least 90° to form two of the corners of the rectangular core and the adjacent half yoke sections. Some over bending is assumed to account for the elastic stress in the corner which may deflect the corner from being as close as possible to 90° (within a few angular minutes). In view of this the outer ends of the lower clamping blocks 45, 47 are beveled at an acute angle to permit over bending of the half yoke sections during their rotation to an angle of at least 90° to form the two corners of the rectangular core. The next core laminate comes on top of the one already formed and it is subjected to the same bending procedure described above, while the spacing between the pairs of clamping blocks 44, 45 and 46, 47 is extended to account for the increase in the distance between the corner bending lines of the laminate which is placed on top of a previous one. Such a repeat procedure is repeated as many times as needed to produce the multiple turns of the full core. A curvature to minimize the core loss increase due to bending is insured in the corner line by machining the ends of the lower clamping blocks 45 and 47 and adjacent ends of the bending bocks 48, 49 forming the corner bending radius, which shall be within $0.5d<r<3d$, where d=steel thickness, (i.e. the radius of curvature for bending is more than half and less than three times the steel thickness). In accordance with one embodiment of the invention the halves of the core may be provided with adhesive bonding to improve its magnetic and noise performance. In this embodiment an adhesive spray is applied to the top of the laminate after it is cut but prior to it being positioned in the bending device. Adhesive is applied along several lines of the laminate. The bottom surfaces of the bending device which come into contact with the upper surface of the laminate preferably are provided with grooves (not shown) corresponding to the lines of adhesive so that the bottom surfaces do not contact the adhesive. After the core is formed, it is assembled with the coils by inserting the two core halves into the coil openings or by winding the coils onto the core and then joining the two halves together.

While there has been described a preferred embodiment of the invention, it will be understood that further modifications may be made without departing from the spirit and scope of the invention as set forth in the appended claims.

What is claimed is:

1. A method of making transformer core laminates with bent corners from magnetic strip material having a predetermined thickness and power loss in the manufacture of a low-stress polyhedral core for a power transformer comprising:

mechanically bending corners in each laminate about predetermined bending lines while limiting the zone in each corner where the laminate is subject to plastic deformation to <5 d where d=laminate thickness, so that the specific power loss in the transformer core will equal that of the magnetic strip material except within said zone, where the power loss is higher due to plastic deformation of the magnetic strip material.

2. A method according to claim 1 wherein each corner of each transformer core laminate is produced by subjecting the laminate to one step of deformation by bending to produce a full 90° corner, comprised of one 90° bend.

3. A method according to claim 1 wherein each corner of each transformer core laminate is produced by subjecting the laminate to two steps of deformation by bending to produce a full 90° corner, comprised of two 45° bonds.

4. A method according to claim 1 wherein each corner of each transformer core laminate is produced by subjecting the laminate to three steps of deformation by bending to produce a full 90° corner, comprised of three 30° bends.

5. A method according to claim 2 for producing a transformer core laminate consisting of two pieces, half-laminates each having two right corners comprising the steps of:

cutting the strip of magnetic laminate into two pieces of predetermined length each corresponding to one-half of the length of a single turn of the core and reflecting the position of the turn in the core, and producing each right corner in each half-laminate by one 90° bend, and forming a closed turn by producing a butt joint between the ends of the two half-laminates.

6. A method according to claim 3 for producing a transformer core laminate consisting of two pieces, half-laminates each having two right corners comprising the steps of:

cutting the strip of magnetic laminate into two pieces of predetermined length each corresponding to one half of the length of a single turn of the core and reflecting the position of the turn in the core, producing each right corner in each half-laminate by two 45° bends, and forming a closed turn by producing a butt joint between the ends of the two half-laminates.

7. A method according to claim 4 for producing a transformer core laminate consisting of two pieces, half-laminates each having two right corners comprising the steps of:

cutting the strip of magnetic laminate into two pieces of predetermined length each corresponding to one-half of the length of a single turn of the core and reflecting the position of the turn in the core, producing each right corner in each half-laminate by three 30° bends, and forming a closed turn by producing a butt joint between the ends of the two half-laminates.

8. A method of making transformer core laminates with bent corners from magnetic strip material having a predetermined thickness and power loss in the manufacture of a low-stress polyhedral core for a power transformer comprising the steps of:

cutting a strip of the magnetic material to a predetermined length corresponding to one-half the length of a single turn of the core and reflecting the position of the turn in the core to form a rectangular half-laminate, positioning the half-laminate between a male die and a female die at a bending station, moving the male die toward the female die and against the half-laminate so that a first bend in a first corner is made about a predetermined bending line and at a predetermined angle, advancing the half-laminate through the bending station to reach a position for the formation of a second corner in the laminate and, moving the male die toward the female die and against the half-laminate so that the first bend in the second corner of the laminate is made about a predetermined bending line and at a predetermined angle, and during the bending of each corner limiting the zone in each corner where the laminate is subject to plastic deformation to <5 d, where d=lamination thickness, so that the specific power loss in the transformer core will equal that of the magnetic strip material except within said zone, where the power loss is higher due to plastic deformation of the magnetic strip material.

9. A method according to claim 8 wherein each predetermined angle is 90° and each corner of each transformer core laminate is produced by subjecting the laminate to one step of deformation by bending to produce a full 90° bend.

10. A method according to claim 8 wherein each predetermined angle is 45° and each corner of each transformer core laminate is produced by subjecting the laminate to two steps of deformation by bending to produce a full 90° corner, comprised of two 45° bends.

11. A method according to claim 8 where each predetermined angle is 30° and each corner of each transformer core laminate is produced by subjecting the laminate to three steps of deformation by bending to produce a full 90° corner, comprised of three 30° bends.

12. A method according to claim 10 wherein each transformer core laminate is advanced between each step of deformation at each corner.

13. A method according to claim 11 wherein each transformer core laminate is advanced an equal distance between each step of deformation at each corner.

14. A method according to claim 8 by forming the corners so that at no time the convex tip of the bend comes into direct contact with a female part of the die and no part of the laminate is simultaneously in direct contact with the male and female parts of the die.

15. A method of making core laminates with bent corners according to claim 2 comprising the steps of:

cutting a strip of magnetic laminate to a predetermined length corresponding to one-half the length of a single turn of the core and reflecting the position of the turn in the core, said predetermined length including a core leg section intermediate a pair of half yoke sections, clamping the core leg section adjacent one end thereof between a pair of clamping blocks, placing at least one bending block against one of the half yoke sections adjacent one of the clamping blocks, and applying a force to the bending block to rotate one end of the half yoke section through an angle of at least 90° to form one of the corners of the core.

16. A method according to claim 15 comprising the steps of:

placing a pair of bending blocks against the half yoke section adjacent the clamping blocks and clamping the half yoke section between said bending blocks, and applying a force to one of the bending blocks to rotate one end of the half yoke section through an angle of at least 90° to form one of the corners of the core.

17. A method according to claim 15 comprising the steps of: clamping the opposite end of the core leg section between a second pair of clamping blocks, placing at least one bending block against the other one half yoke section adjacent one of said second pair of clamping blocks, and applying a force to the second bending block to rotate the other one half yoke section through an angle of at least 90° to form a second of the corners of the core.

18. A method of making a low-stress rectangular core according to claim 16 wherein the adjacent ends of the bending block and the clamping block on the same side of the laminate are beveled at an angle of at least 45°.

19. A method according to claim 2 for making a low-stress rectangular core for a power transformer comprising the steps of:

cutting a strip of magnetic laminate to a predetermined length corresponding to one-half the length of a single turn of the core and reflecting the position of the turn in the core, said predetermined length including a core leg section intermediate a pair of half yoke sections, clamping the core leg section adjacent one end thereof between a first pair of clamping blocks, clamping the opposite end of the core leg section between a second pair of clamping blocks, placing a first bending block against one of the half yoke sections adjacent the first pair of clamping blocks, placing a second bending block against the other half yoke section adjacent the second pair of clamping blocks, and applying a force to the bending blocks to rotate the half yoke sections through an angle of at least 90° to form two of the corners of the rectangular core.

20. A method of making a low-stress rectangular core according to claim 19 wherein one clamping block in each of the pairs is located within the rectangular core and the ends of the clamping blocks adjacent the corners of the rectangular core are beveled at an acute angle to permit over bending of the half yoke sections during their rotation to an angle of at least 90° to form the two corners of the rectangular core.

21. A method of making a low-stress rectangular core according to claim 19 comprising:

repeating the steps of claim 19 a predetermined number of times to produce one-half of a full core, repeating the steps of claim 19 a corresponding predetermined number of times to produce the second half of a full core, assembling each of the two core halves with coils, and joining the two core halves together.

22. A method of making transformer core laminates with bent corners from magnetic strip material having a predetermined power loss in the manufacture of a low-stress polyhedral core for a power transformer comprising the steps of:

mechanically bending corners in each laminate about predetermined bending lines while limiting the plastic deformation to ±1.5 mm from each bending line so that the specific power loss in the transformer core will equal that of the magnetic strip material except within plus or ±1.5 mm from the bending lines, where the power loss is higher due to plastic deformation of the magnetic strip material.

23. A method of making transformer core laminates with bent corners from magnetic strip material having a predetermined power loss in the manufacture of a low-stress polyhedral core for a power transformer comprising the steps of:

cutting a strip of the magnetic material to a predetermined length corresponding to one-half the length of a single turn of the core and reflecting the position of the turn in the core to form a rectangular half-laminate, positioning the half-laminate between a male die and a female die at a bending station, moving the male die toward the female die and against the half-laminate so that a first bend in a first corner is made about a predetermined bending line and at a predetermined angle, advancing the half-laminate through the bending station to reach a position for the formation of a second corner in the laminate and, moving the male die toward the female die and against the half-laminate so that the first bend in the second corner of the laminate is made about a predetermined bending line and at a predetermined angle, and during the bending of each corner limiting the plastic deformation to ±1.5 mm from each bending line so that the specific power loss in the transformer core will equal that of the magnetic strip material except within +1.5 mm from the bending lines, where the power loss is higher due to plastic deformation of the magnetic strip material.

* * * * *

UNITED STATES PATENT AND TRADEMARK OFFICE

CERTIFICATE OF CORRECTION

PATENT NO. : 6,473,961 B1 
DATED : November 5, 2002
INVENTOR(S) : Vladimir Segal et al.

It is certified that error appears in the above-identified patent and that said Letters Patent is hereby corrected as shown below:

Column 8,
Table 1, left-most column: "Wound, 2-loop, 3-phase" should read -- Wound, 2-loop, 1-phase --

Signed and Sealed this

Thirty-first Day of August, 2004

JON W. DUDAS
*Director of the United States Patent and Trademark Office*